US005297112A

United States Patent [19]

Cohen et al.

[11] Patent Number: 5,297,112

[45] Date of Patent: Mar. 22, 1994

[54] SETTING A DOUBLE FACE WATCH

[75] Inventors: Raphael Cohen, Geneva; Maurice Jeanmonod, Boussens; Jean-Daniel Dubois, Le Sentier, all of Switzerland

[73] Assignee: Rafal SA, Carouge, Switzerland

[21] Appl. No.: 868,505

[22] Filed: Apr. 15, 1992

[30] Foreign Application Priority Data

Apr. 15, 1991 [CH] Switzerland ..... 1113/91

[51] Int. Cl.[5] ..... G04B 25/00; G04B 19/00

[52] U.S. Cl. ..... 368/190; 368/185

[58] Field of Search ..... 368/185–199

[56] References Cited

FOREIGN PATENT DOCUMENTS

| | | |
|---|---|---|
| 0334088 | 9/1989 | European Pat. Off. . |
| 244776 | 5/1911 | Fed. Rep. of Germany . |
| 579364 | 6/1933 | Fed. Rep. of Germany . |
| 1293365 | 3/1934 | Fed. Rep. of Germany . |
| 497082 | 11/1919 | France . |
| 7594 | 11/1893 | Switzerland . |
| 57805 | 11/1911 | Switzerland . |
| 127319 | 8/1927 | Switzerland . |

*Primary Examiner*—Bernard Roskoski

*Attorney, Agent, or Firm*—Young & Thompson

[57] ABSTRACT

A double faced watch has a movement driving a first gearing actuating a first hands array cooperating with a first dial and a second dial 31 on its opposed face cooperating with a second hands array 32, 33', 43. An automatic winding mass 19 is pivoted concentrically to the two hands arrays by a ball bearing the internal housing of which is fastened on a sleeve giving passage to an axle 7, 7', carrying one hand of the first hands array. This axle 7, 7' is used as a driver for the driving of the second hands array. A time setting stem 55 is axially slidable between two positions, in one of which its rotation sets one of the hands arrays and in the other of which its rotation sets the other hands array. A tilting member 62 (FIG. 6) ensures that the setting stem 55 slides in the opposite direction from a sliding pinion 47 so that the stem 55 and pinion 47 are alternately in driving relation with one or the other of the drive trains of the two hands arrays.

12 Claims, 5 Drawing Sheets

SETTING A DOUBLE FACE WATCH

The present invention has for its object an automatic watch having a double face mecanical movement, that is to say comprising a double display located each one on a face of the watch.

One knows watches having a double display, front-back, but they are provided with a quartz electro-mechanical movement, or they comprise two distinct movements disposed back to back.

The quartz movement watches do not enable easily complicated displays, moon phases, tides, perpetual daydate and so on and furthermore the actual tendancy for the watches of the top level is towards the mechanical movements.

Locating two movements back to back increases greatly the thickness of the watchpiece and furthermore does not guarantee a perfect synchronism of the two displays.

The present invention has for its object the realization of an automatic mechanical watch movement driving two displays disposed on either side of the timepiece and which distinguishes itself in that it comprises an automatic mechanical movement driving a first gearing actuating a first hand type time display, cooperating with the first dial, characterized by the fact that it comprises a second dial on its opposed face cooperating with a second display, by the fact that the automatic winding mass is pivoted concentrically to the hand display by means of a ball bearing the internal casing of which is fastened on a sleeve giving passage to a shaft carrying a hand of the first hand display, and by the fact that this through shaft is used as a driver for the driving of the second display.

The attached drawing shows shematically and by way of example one embodiment of the automatic watch having a double display according to the invention.

Figure 1:
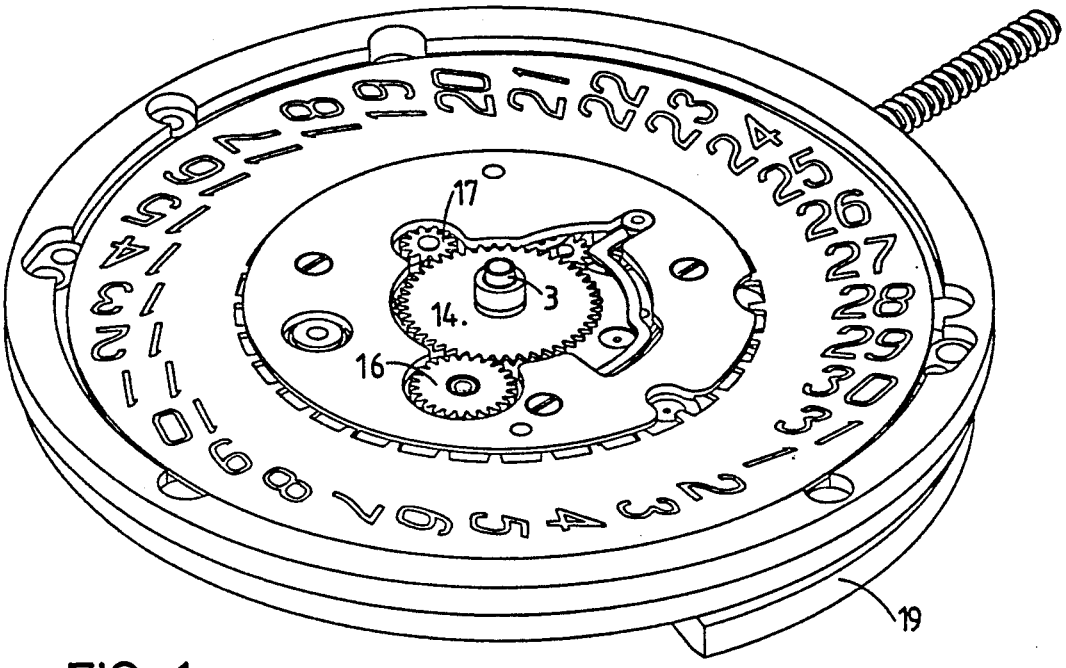
FIG. 1 is a perspective view of the front face of the movement of the watch according to the invention.
Figure 2:
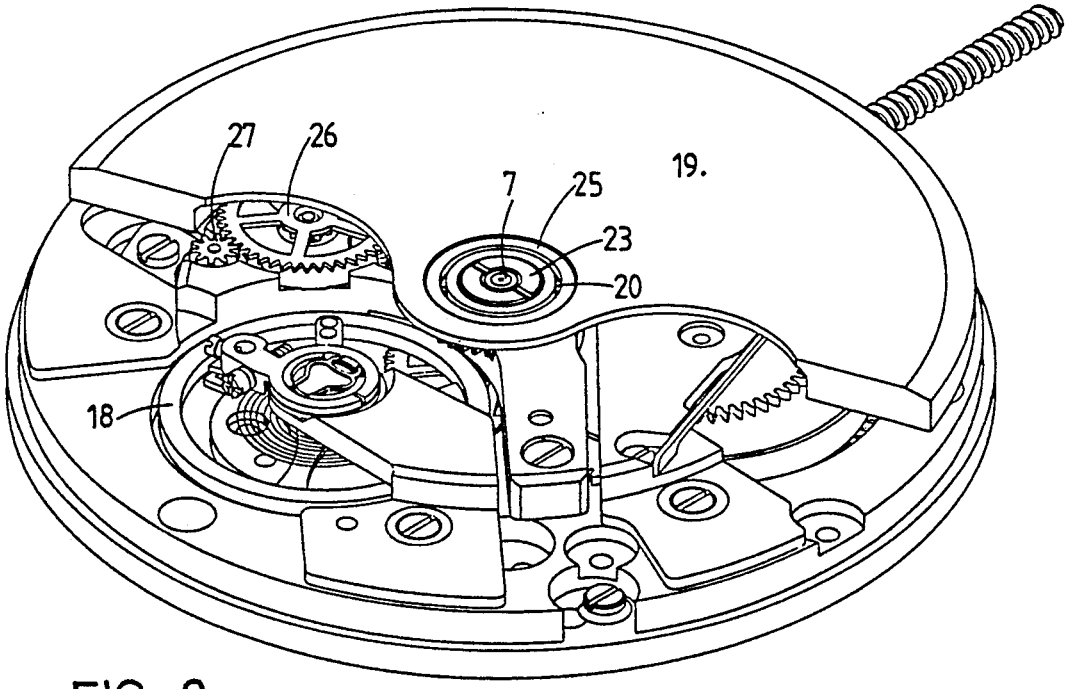
FIG. 2 is a perspective view of the reverse side of the movement of the watch according to the invention.
Figure 3:
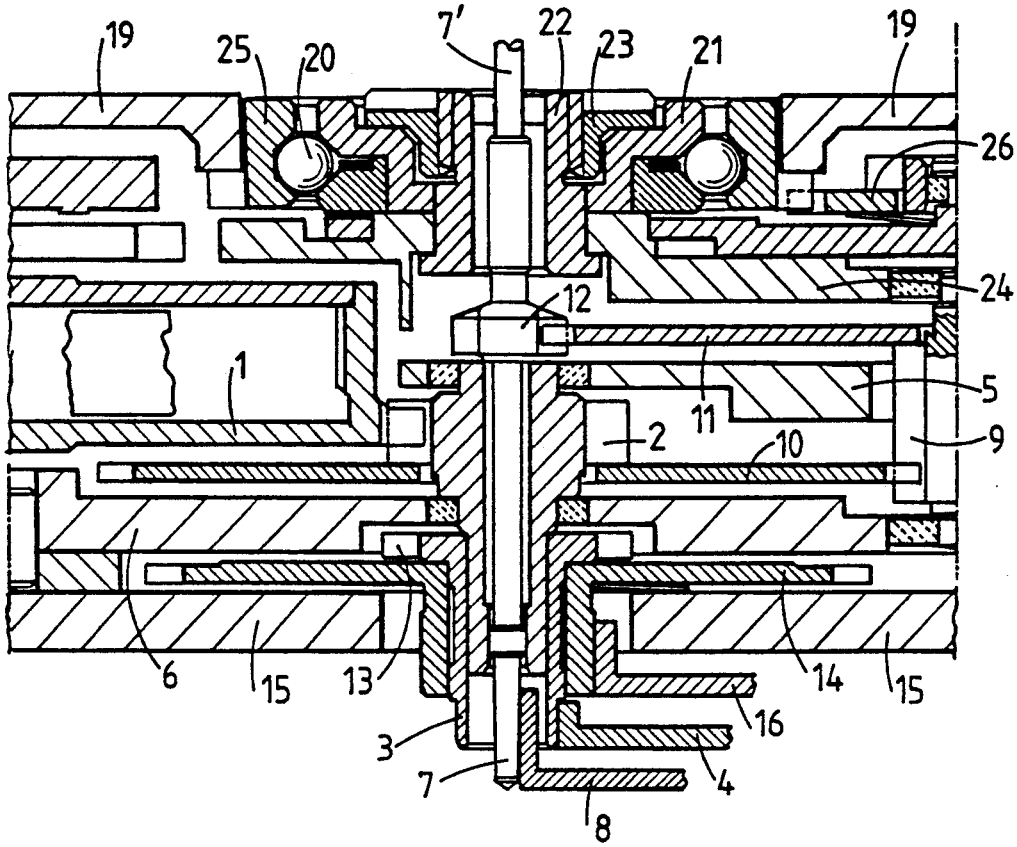
FIG. 3 is a partial cross-section of the movement provided with a traditional display.

In the embodiement shown, the watch comprises an automatic mechnical movement presenting a barrel 1, the toothing of the casing of which meshes with a center pinion 2 carrying the minute wheel 3 making one complete revolution during one hour and carrying itself the minutes hand 4. The center pinion 2 is pivoted by means of bearings between two bridges or plates 5, 6. This center pinion 2 is axially traversed from one side to the other and this bore serves as a bearing for a seconds axle 7, traversing throughout the center pinion and one end of which carries the seconds hand 8. A movable member pivoted between the bridges 5, 6 presents a pinion 9 meshing with a toothed zone 10 fast with a center pinion 2 and a wheel 11 meshing with a pinion 12 fast with the seconds shaft 7. The demultiplication thus realized is such that the seconds shaft makes one revolution in one minute.

The minutes wheel 3 carries a toothing 13 cinematically connected through an intermediate member, pinion-wheel, not shown, to the hours wheel 14, located just underneath the dial 15, pivoted onto the minutes wheel 3 and carrying the hours hand 16. The demultiplication introduced by this cinematical linkage is such that the hours wheel makes one complete revolution within twelve hours.

The setting to time of this first time indication which is conventional is made by the winding stem, not shown, which in pulled up position or time setting position, drives through a gear train the pinion 17 meshing with the hours wheel 14.

This movement comprises naturally a conventional regulating gearing comprising a spiral balance 18 and an escapement.

This automatic movement comprises further a winding mass 19 pivoted at the center of the movement, coaxially of the seconds axle 7, by means of a ball bearing 20 the internal housing of which 21 is fixed and mounted on a sleeve 22 by means of a nut 23, this sleeve being driven into a bridge 24.

The outside casing 25 of the roller band 20 carries the automatic winding mass 19 and is provided with a toothing meshing with a ratchet wheel 26 driving the pinion 27 of the axis of the barrel and in only one direction of rotation.

It will be noted that the sleeve 22 carrying the internal casing 23 of the ball bearing 20 of the automatic winding mass is axially pierced throughout and gives passage to the seconds axle 7 which is extended beyond this sleeve and the end 7' of which is used as a driver for the second additional hand display of the movement.

Figure 4:
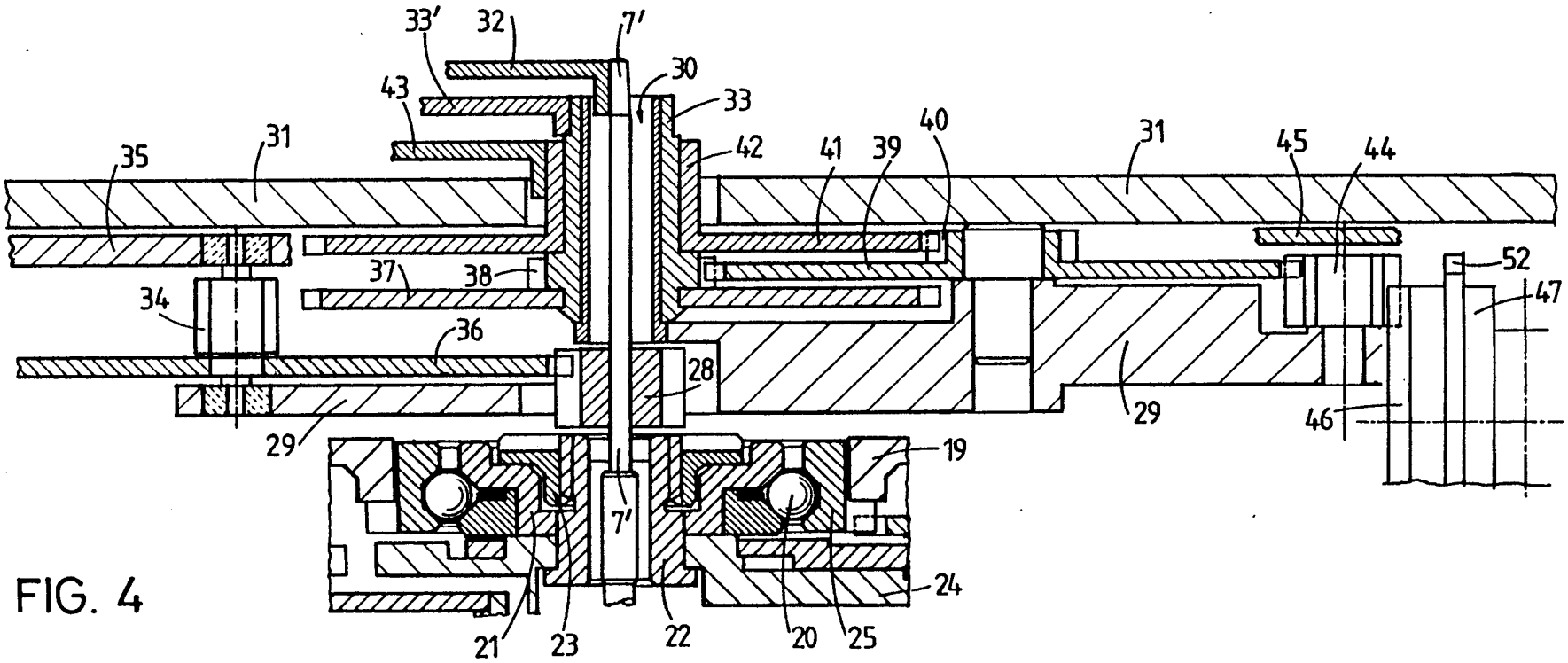
FIG. 4 is a cross-section showing the hand drive and a portion of the time setting mechanism of the additional display driven by the watch movement.

One of the original particularity of this automatic watch movement is that the seconds axle 7 is going throughout and carries at each of its ends a seconds hand. On the end 7' of the seconds shaft 7, going axially through the ball bearing of the oscillating mass 19, is fixed a pinion 28 (FIG. 4). This pinion 28 crosses an additional plate 29. This additional plate 29 carries a hollow axis for the additional hand display 30, standing coaxially with the seconds axis 7, 7' and crossing the second dial 31.

Figure 5:
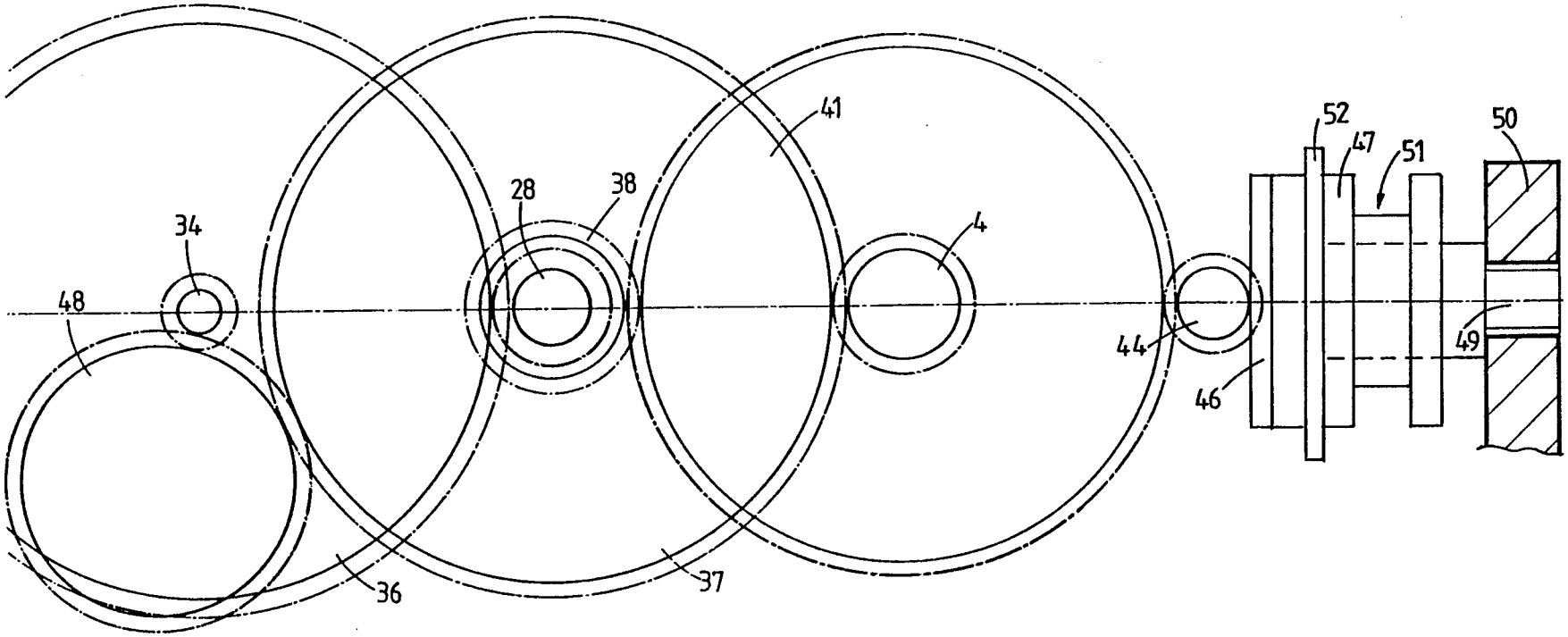
FIG. 5 is a plan view of the additional hand drive.
Figure 6:
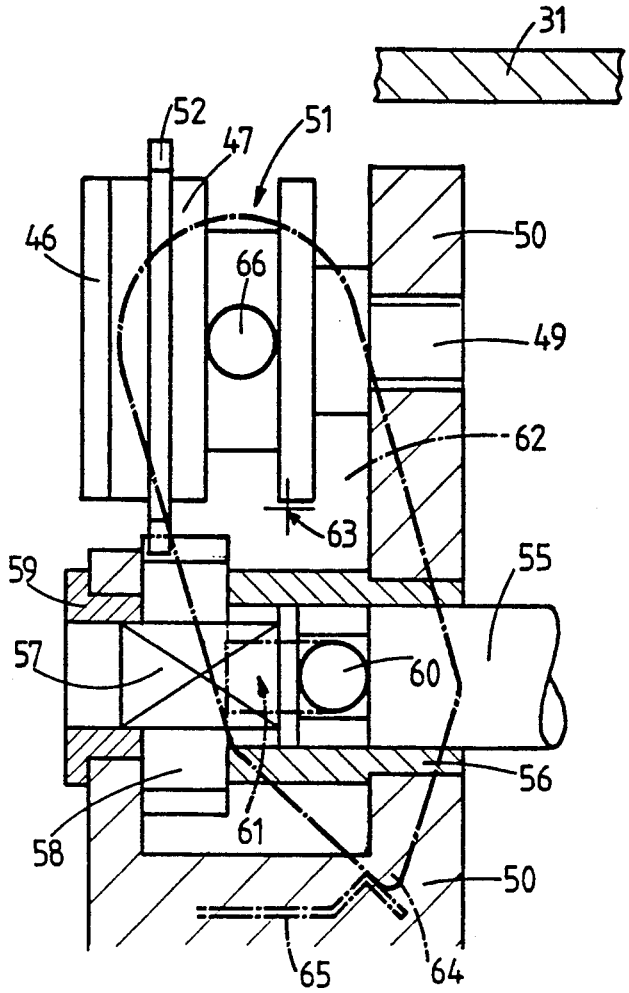
FIG. 6 shows partially the time setting mechanism of the additional display.
Figure 7:
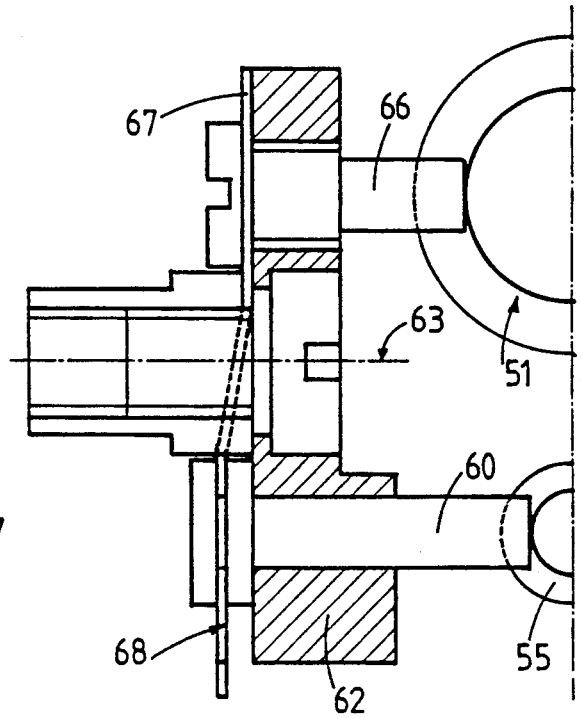
FIG. 7 is a view from the right of FIG. 6.

The end 7' of the seconds axle 7, 7' carries a second hand for the seconds 32. An additional minutes pinion 33 is pivoted on the hollow shaft 30 and carries a minutes wheel 37 meshing with an intermediate wheel 48 (FIG. 5) which in its turn meshes with the pinion 34 of the movable member pivoted between the additional plate 29 and a bridge 35. This movable member comprises a wheel 36 meshing with the pinion 28 fast with the seconds axle 7, 7'. The demultiplication is such that the minutes wheel 37 makes one complete rotation in one hour.

The additional minutes pinion 33 carries further a second minutes hand 33' and a pinion 38 meshing with the wheel 39 of a movable member pivoted on the additional plate 29 the pinion 40 of which meshes with the additional hours wheel 41 fast with a sleeve 42 pivoted on the additional pinion 33 and the end of which carries a second hours hand 43. This cinematical linkage makes that the additional hours wheels 41 makes one revolution in twelve hours.

This additional display or hand display mounted on the additional plate 29 and the bridge 35 may be conceived as a module which can be fixed onto the movement confering to it a double display driven by the same movement. These displays are thus necessarily in synchronism even though they can display different times of course.

It is evident that this additional display provided under the form of a removable and interchangable module can comprise other indications such as moon phases, tides, perpetual daydates, and so on.

Thanks to this realization, there is obtained a movement having two strictly synchronized displays, which is relatively thin and which permits a great variety of additional displays upon demand.

The additional time display comprises also a time setting mechanism which comprises a pinion 44 pivoted between the additional plate 29 and a bridge 45 the toothing of which cooperates with the frontal toothing, crown-shaped, 46, of a sliding pinion 47 slidingly mounted on a shaft 49 fast with the casing ring or with a plate 50. This sliding pinion 47 comprises a groove 51 and a peripheral toothing 52.

The actuating mechanism of this sliding pinion 47 is particular so that the second time setting stem of this additional display is, for esthetical reasons, also situated in the middle plan of the movement or at least in the same plan as the first time setting stem or winding stem.

This implies that this second time setting stem 55 be parallely displaced with respect to the axis of the sliding pinion 47. This time setting stem 55 slides in a sleeve 56 fast with the plate 50 and comprises a driving square 57 sliding in a pinion 58 meshing with a peripheral toothing 52 of the sliding pinion 47. The end of the time setting stem slides in a sleeve 59 fast with the plate 50 which serves also for the axial positioning of the pinion 58 located between this plate and the sleeve 56.

The time setting stem 55 is fast with a pin 60, perpendicular to the axis of the stem and crossing the sleeve 56 through a slot 61. This pin 60 is mounted on a tilting lever 62 pivoted at 63 and one end of which has a beak 64 cooperating with a spring snap 65. The other end of the tilting lever 62 carries a pin 66 entering into the groove 51 of the sliding pinion 47. Thus the axial displacement of the time setting stem 55 causes axial displacement in the opposite direction of the sliding pinion 47 and thus its engagement with, or displacement from, the pinion 44.

The pin or screw 66 is screwed into the tilting lever 62 and fixes a blade-spring 67 the lower part 68 of which is disposed in a groove of the head of the pin 60. This enables acting with a tool on the lower end of this blade-spring 67 to disengage the pin 60 from the time setting stem 55 which can than be taken away for dismounting the movement.

It is evident that in a variant the time setting stem 55 could in supplemental axial position actuate the time setting of the first display as well as the manual winding of the movement.

In a variant, the through shaft could be the one carrying the minutes hands.

We claim:

1. A double faced watch having first and second dials on opposite sides thereof and first and second hand displays overlying said first and second dials, respectively, first and second gearing for setting said first and second hands arrays, a rotatable setting stem slidable axially between a first position in which rotation of said setting stem actuates said first gearing to set said first hands array and a second position in which rotation of said setting stem does not move said first gearing, a rotatable member slidable in a direction parallel to said setting stem between a first position in which rotation of said member actuates said second gearing to set said second hands array and a second position in which rotation of said member does not move said second gearing, means to rotate said member, and a lever pivotally interconnecting said stem and said member for movement in opposite axial directions such that when said stem is in its respective first and second positions said member is in its respective second and first positions.

2. A double faced watch as claimed in claim 1, wherein rotation of said setting stem rotates said member.

3. A double faced watch as claimed in claim 1, wherein said member is a pinion slidable on an axially fixed shaft.

4. A double faced watch as claimed in claim 1, wherein said lever swings in a plane perpendicular to said dials.

5. A double faced watch as claimed n claim 1, wherein said setting stem and said member are continuously in mesh with each other.

6. A double faced watch as claimed in claim 1, which has winding mechanism and an inertia weight rotatable about a common axis of said hands arrays automatically to wind a winding mechanism of said watch.

7. A double faced watch having first and second dials on opposite sides thereof and first and second hands arrays overlying said first and second dials, respectively, first and second gearing for setting said first and second hands arrays, a first rotatable setting stem slidable axially between a first position in which rotation of said first setting stem actuates said first gearing to set said first hands array and a second position in which rotation of said first setting stem does not move said first gearing, a rotatable member slidable in a direction parallel to said first setting stem between a first position in which rotation of said member actuates said second gearing to set said second hands array and a second position in which rotation of said member does not move said second gearing, a second rotatable setting stem diametrically opposed to said first setting stem and slidable axially between a first position in which rotation of said second setting stem actuates said second gearing to set said second hands array and a second position in which rotation of said second setting stem does not move said second gearing, means to rotate said member, and a lever pivotally interconnecting said second setting stem and said member for movement in opposite axial directions such that when said second setting stem is in its respective first and second positions said member is in its respective first and second positions.

8. A double faced watch as claimed in claim 7, wherein rotation of said second setting stem rotates said member.

9. A double faced watch as claimed in claim 7, wherein said member is a pinion slidable on an axially fixed shaft.

10. A double faced watch as claimed in claim 7, wherein said lever swings in a plane perpendicular to said dials.

11. A double faced watch as claimed in claim 7, wherein said second setting stem and said member are continuously in mesh with each other.

12. A double faced watch as claimed in claim 7, which has a winding mechanism and an inertia weight rotatable about a common axis of said hands arrays automatically to wind a winding mechanism of said watch.

* * * * *